United States Patent [19]

Brucken et al.

[11] 4,105,370

[45] Aug. 8, 1978

[54] VARIABLE DISPLACEMENT COMPRESSOR WITH THREE-PIECE HOUSING

[75] Inventors: Byron L. Brucken, Miamisburg; Roy E. Watt, Brookville, both of Ohio

[73] Assignee: General Motors Corporation, Detroit, Mich.

[21] Appl. No.: 798,583

[22] Filed: May 19, 1977

[51] Int. Cl.[2] ..... F04B 1/26

[52] U.S. Cl. ..... 417/222; 74/60; 92/12.2; 417/269

[58] Field of Search ..... 417/269–272, 417/222; 74/60; 91/506; 92/12.2

[56] References Cited

U.S. PATENT DOCUMENTS

| | | | |
|---|---|---|---|
| 2,380,574 | 7/1945 | Beeh et al. | 417/269 X |
| 2,835,436 | 5/1958 | Steinhagen et al. | 417/269 |
| 3,006,324 | 10/1961 | Shaw | 74/60 X |
| 3,010,403 | 11/1961 | Zubaty | 417/222 X |
| 3,062,020 | 11/1962 | Heidorn | 417/270 X |
| 3,085,514 | 4/1963 | Budzich | 417/269 X |
| 4,061,443 | 12/1977 | Black et al. | 417/222 |

*Primary Examiner*—Carlton R. Croyle
*Assistant Examiner*—Edward Look
*Attorney, Agent, or Firm*—Edward P. Barthel

[57] ABSTRACT

A wobble plate compressor including a three-part housing in the form of a front shell-like section, defining a wobble plate mechanism cavity, an intermediate cylinder block section and a rear head section, all of the parts being connected in series such as by elongated cap screws. A blind bore in the first section end cover receives a piston to define an expansible chamber actuator. Passage means are formed in the housing for conducting hydraulic fluid from the housing sump to the inlet of pump means. Hydraulic liquid outlet passage means, providing a flow passage between the front and rear heads, are formed in the housing such that control valve means in the rear head can affect the flow of the liquid or oil from the sump to the expansible chamber, causing the modulating piston to vary the angle of the wobble plate mechanism and thus the pumping capacity of the compressor. A generally spherical guide shoe is mounted in an axial shiftable manner on a guide pin projecting radially from the wobble plate with the spherical shoe slidable between a pair of opposed cylindrical guides whereby a line contact is maintained between the spherical guide shoe and the cylindrical guides to prevent rotation of the wobble plate element while permitting angular movement thereof relative to the drive shaft.

3 Claims, 5 Drawing Figures

VARIABLE DISPLACEMENT COMPRESSOR WITH THREE-PIECE HOUSING

This invention relates to a wobble plate refrigerant compressor and more particularly to an automotive air conditioning variable displacement compressor having an improved three-piece housing.

In the co-pending U.S. patent application Ser. No. 747,043, filed Dec. 2, 1976, now U.S. Pat. No. 4,061,443, to Dennis A. Black and Byron L. Brucken, assigned to the same assignee as the present application, a variable displacement automotive air conditioning wobble plate compressor is described. The present invention discloses an improved three-piece housing, preferably formed as cast aluminum members, providing an economical compressor housing assembly with fewer parts thereby achieving a simplification of the manufacturing and assembly operation.

In one of its broadest aspects, the object of this invention is to provide an improved automobile air conditioning wobble plate compressor housing wherein a first shell-like wobble plate mechanism section, a second intermediate cylinder block section and a rear cylinder head section are connected in series to define a three-part housing.

It is another object of the present invention to provide an improved cast aluminum three-part compressor housing for a variable output axial compressor of the wobble plate type having integral guide shoe means to prevent rotation of the wobble plate element without preventing angular movement thereof relative to the drive shafts. A pair of integral concave cylindrical opposed guides are cast with the front housing shell for reception of a substantially spherical guide shoe mounted in an axially shiftable manner on a guide pin projecting radially from one side of the wobble plate. The spherical guide shoe is freely shiftable for reciprocal movement on the guide pin during angular movement of the wobble plate, whereby only a line contact is maintained between the shoe and each of its cylindrical guides.

Further objects and advantages of the present invention will be apparent from the following description, reference being had to the accompanying drawings wherein a preferred embodiment of the present invention is clearly shown.

Figure 1:
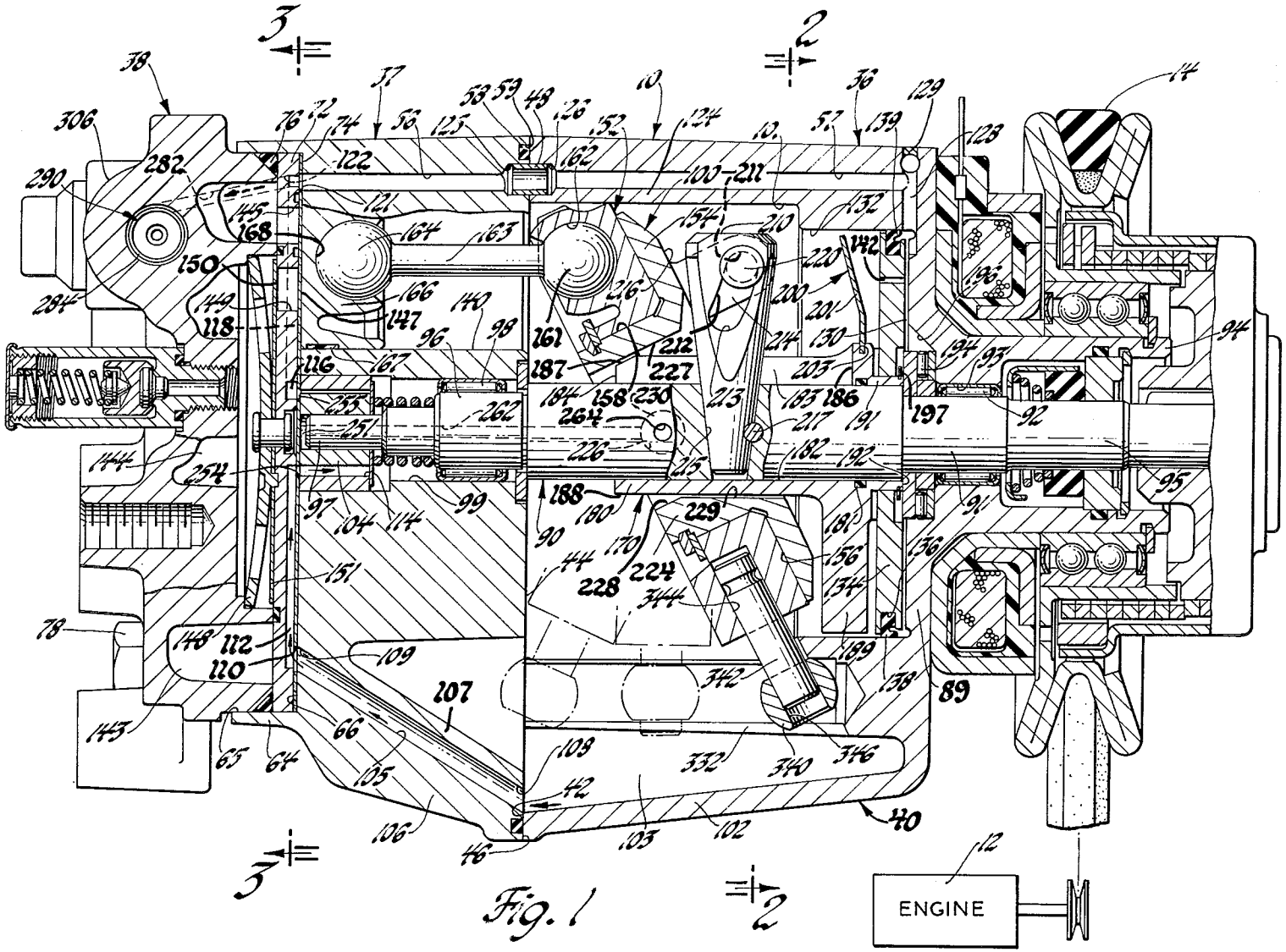
FIG. 1 is a vertical sectional view showing preferred form of the invention.

Referring now to the drawings wherein a preferred embodiment of the present invention has been disclosed, reference numeral 10 in FIG. 1 designates a variable displacement axial compressor which is adapted to be driven by the main car engine 12 through suitable belt means 14 in a manner shown and described in the above-mentioned Black et al. patent application. In the clutch starting and stopping system, described in the mentioned Black et al. patent application, the compressor's principle of operation involves reducing the refrigerant pressure drop between the evaporator and the compressor by varying the compressor displacement to match the cooling requirement of the car. As a result, at moderate temperatures the compressor capacity is modulated to pump only the amount of refrigerant required to cool the car. Suction gas is delivered from the evaporator to the compressor at higher pressures and densities because, with the elimination of the suction throttling valve there is a reduction of line pressure drop. The fact that suction gas enters the compressor at a higher density together with the reduction of mechanical or friction losses achieves a reduction in the compressor's power requirements.

Figure 5:
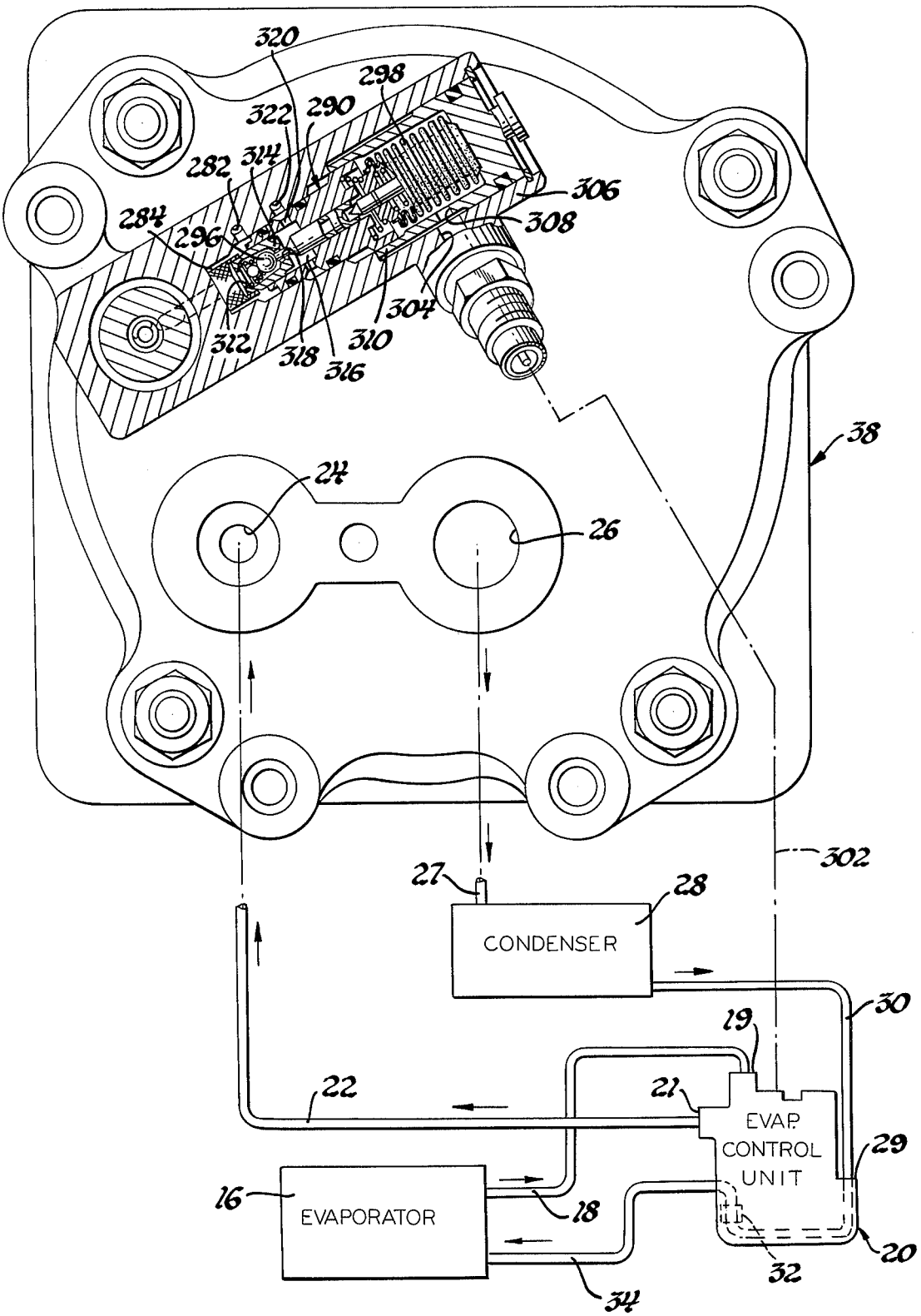
FIG. 5 is an end elevational view, with parts broken away, of the compressor rear head together with a schematic of a cooling system.

As shown schematically in FIG. 5, the refrigerating system includes the usual refrigerant evaporator 16 having an outlet line 18 leading to one inlet 19 of a receiver 20 and exits at 21 into line 22 leading to the compressor inlet 24. The compressed refrigerant leaves the compressor 10 through an outlet 26 into line 27 connected to a conventional condenser 28. The condensed refrigerant returns to a second inlet 29 of the receiver 20 by line 30 from whence the liquid refrigerant flows through a suitable pressure reducing means, which for the purposes of illustration has been shown as an expansion valve 32 in the receiver, and thereafter returns to the evaporator by line 34. The compressor 10 and condenser 28 are preferably located in the engine compartment of the car while the evaporator 16 is arranged in an enclosure so as to cool air for the passenger compartment of the car in the usual manner.

Figure 4:
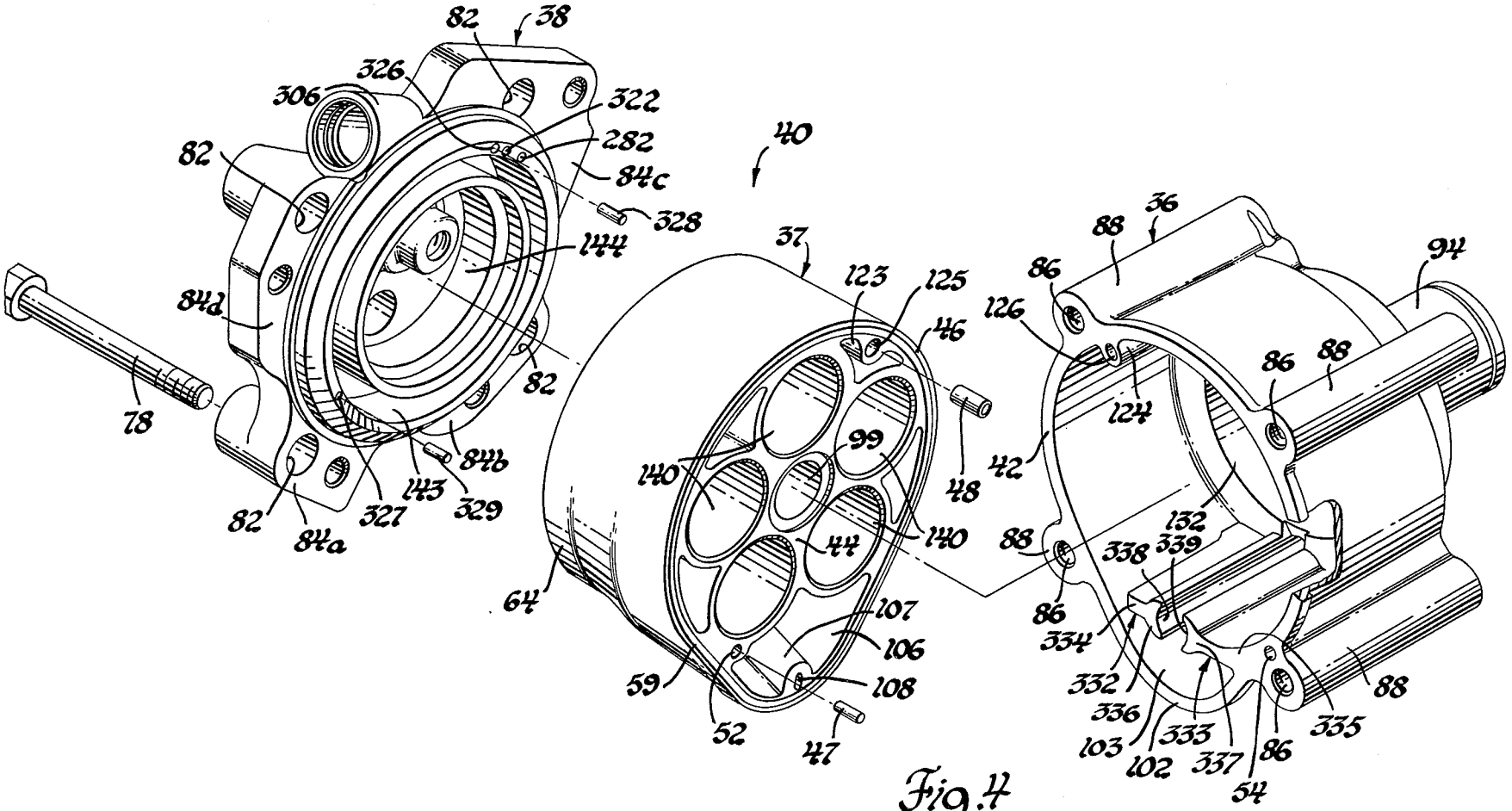
FIG. 4 is an exploded perspective view of the compressor three-piece housing of the present invention.

As best seen in FIGS. 1 and 4, the improved compressor 10 of the present invention includes a three-part housing having a first shell-like cup-shaped front section 36, a mating second or intermediate cylinder casing section 37 and a third rear cylinder head section 38 adapted to be connected in series to form the compressor housing assembly 40. The front shell section 36 has a rearwardly directed continuous peripheral edge 42. The second cylinder casing section 37 has a forwardly directed face 44 and co-planar peripheral edge 46 which when abutted against the front section edge 42 such that the first and second sections are in flush confronting engagement at a common transverse plane. The first and second sections are centered relative to one another by alignment means such as pins 47 and a connector tube portion 48 shown assembled in FIG. 4. Axial bores 52 in the second section 37 and at 54 in the first section 36 are provided for the alignment pin 47 while axial passageways 56 and 57 in second section 37 and first section 36 respectively are connected by tube portion 48. The first 36 and second 37 sections are sealed to one another by elastomeric sealing ring 58 (FIG. 1) compressed in an annular groove 59 formed in the forwardly facing edge 44 of the second section 37.

The second intermediate cylinder section 37 has an integral extending peripheral flange portion 64, extending axially from circular internal shoulder 66, with the flange portion inner wall 65 being of straight cylindrical form for receiving or fitting over third rear head section 38 in a telescopic manner. Located between the second and third sections, on shoulder 66, is a valve plate 72 having concentric reed plate 74 interposed therebetween with the rear head section sealed to the second section by an elastomeric sealing ring 76.

As viewed in FIG. 4 securing means are provided for removably attaching the rear head section 38 to the front shell-like section 36 by means of cap screws 78. In the disclosed form four cap screws extend through circumferentially spaced holes 82 in an outwardly extending annular flange 84a–84d (FIG. 3) integral with said rear head member, said holes 82 being axially aligned with a plurality of circumferentially spaced holes 86 (FIG. 2) in outwardly extending bosses 88 integral with front shell-like portion 36. Extending through hole 82 and threaded into hole 86 are a plurality of cap screws or bolts 78 (one being shown) for drawing the first section 36 axially in one direction enabling the edge 42 to abut against the seal ring 58 and rear head 38 to contact seal ring means 76 for holding the housing sections in assembled relationship. The seal rings 58 and 76 are thus deformed into sealing engagement with their adjacent housing sections.

The compressor main drive shaft 90 has its forward bearing portion end 91 rotatably mounted or journaled on front needle bearings 92 in axial bore 93 formed in a protruding integral tubular extension 94 located on the front head end cover portion 89 outer surface. The extension 94 is coaxial with and surrounds the shaft intermediate end 95 in concentric fashion. The shaft 90 has its rearward reduced end 96 terminating in shaft end 97, journaled on rearward needle bearing 98 in rear axial bore 99 of the housing intermediate cylinder portion 37.

Figure 3:
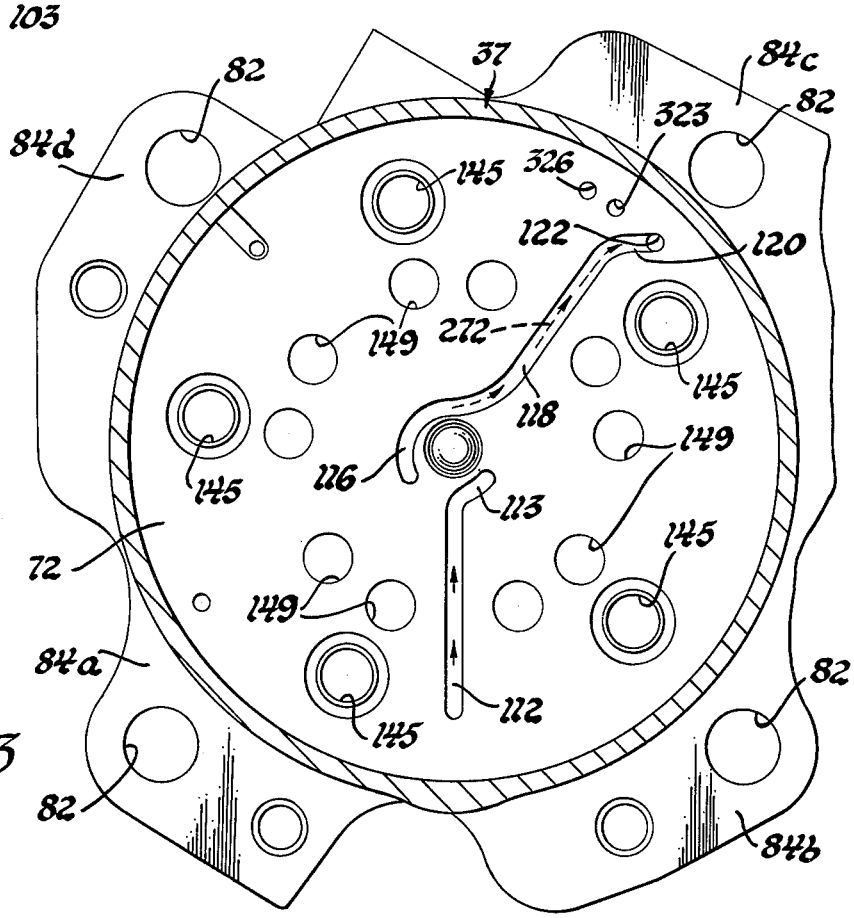
FIG. 3 is a vertical sectional view taken substantially along line 3—3 of FIG. 1.

As viewed in FIG. 1, the shell-like housing front portion defines a cavity 101 which completely encloses compressor wobble plate mechanism 100 and is provided with an integral distended bulge portion 102 forming an oil sump or crankcase region 103. The sump collects, by gravity flow, oil and refrigerant mixture therein received from piston blow-by for circulation through the compressor by suitable oil flow passages providing a lubricating network for its associated bearings and seals. Lubricating oil gear pump means in the form of an oil gear pump assembly 104, driven by shaft end 97 providing a D-shaped quill, in the form of a reduced extension of the shaft rearward end 97, serves to withdraw oil and refrigerant solution from the sump 103 through an oil pickup passage or conduit 105. As seen in FIG. 4, the passage 105 is formed in bottom lobe portion 106 of the intermediate cylinder section 37, by means of integral lobe boss 107, with passage 105 having its inlet end 108 in the plane of face 44. The passage 105, upper outlet end 109 communicates via an aperture 110 in reed valve disc 74 with an aligned vertical slotted passage 112, formed in the inner face of valve plate 72 as seen in FIG. 3. The passage 112 has an arcuate shaped upper end 113 positioned in communication with inlet side 114 of the gear pump 104.

The gear pump outlet communicates with an arcuate portion 116 of an upper oil outlet groove 118, with the groove extending radially outwardly at an acute angle from the vertical of about 30°, to an outer angled or dogleg portion 120 which terminates adjacent the periphery of the valve plate 72. The angled portion 120 of the groove terminates in valve plate orifice 122 which communicates with the oil outlet passage 282 in the rear head section 38 (FIG. 5) communicating with the entrance to a hydraulic control valve to be described. The plate orifice 122 is aligned with a hole 121 in the reed disc 74 which is in turn aligned with axial passageway means in the housing sections 36 and 37, located outboard of the wobble plate mechanism 100. The axial passageway means includes intermediate casing section 37 crossover passageway or duct in its internal boss 123 (FIG. 4), and the front crossover passageway or duct 57 in the front casing section 36 in internal boss 124. The crossover ducts 56 and 57 have aligned juxtaposed counterbores 125 and 126 respectively to receive either end of alignment tube 48 in a press fit manner. The front section 36 includes radial passage 128 communicating at a T-connection with crossover duct 57. The outer end of radial passage 128 is sealed by a plug member 129 while the inner end of radial passage 128 is opened to expansible chamber 130 defined by blind bore 132 and piston means in the form of disc-shaped piston 134.

The modulation piston 134 has a rectangular shaped peripheral edge groove 136 for reception of a resilient rim seal member 138 formed with a reduced annular U-shaped groove on its inner face so as to bias its sealing lip or V ring 139 inwardly. In this way the lip 139 can flex, as necessary, to conform to the walls of bore 132 to further insure proper wiping sealed contact at all times. As the compressor pressurized hydraulic fluid or lubricant is effectively sealed in the expansible chamber 130, except for controlled exit means, which in the disclosed form is a single bleed orifice 142 in modulating piston 134. In the disclosed form the bleed orifice 142 has a diameter of about 0.031 inches. In this way the unloading or outward flow of hydraulic fluid from the chamber 130 via orifice 142 for gravity return to the sump 103 is controlled upon the wobble plate mechanism moving toward its full stroke position as explained in the aforementioned Black et al. application.

The rear cylinder head section 38 for cylinder bores 140 includes an outer suction or inlet chamber 143 and a center discharge chamber 144. As shown in FIG. 1, each compression chamber or cylinder bore 140 communicates with the suction chamber 143 through an inlet port such as the port 145 (FIG. 3). The inlet reed valve disc 72, having inlet reeds 147, controls the flow of refrigerant through the suction inlet ports 145 in accordance with standard practice. The compressed refrigerant leaves each compression bore 140 through a discharge port 149, while a reed valve 150, in a discharge reed valve disc 151, at each discharge port 149 is provided in accordance with standard practice. It will be noted in FIG. 1 that the extent of the opening of the reed valve 150 is limited by a rigid back-up plate member 148 suitably secured to the valve plate 72 as by a rivet.

For purposes of illustrating this invention, a variable displacement five cylinder axial compressor 10 will be described whereas it will be understood that the number of cylinders may be varied without departing from the spirit and scope of the invention. The wobble plate drive mechanism assembly 100 includes a socket plate 152 and a journal element or wobble plate 154. The wobble plate 154 and socket plate 152 define a plane bearing surface 156 and an outer cylindrical journal surface 158 with the wobble plate rotating in unison with the shaft 90. The socket plate 152 has five sockets, one of the sockets being shown at 162, for receiving the spherical ends 161 of five connecting rods, like the connecting rods 163, as seen in FIG. 1. The free ends of each of the connecting rods 163 are provided with spherical portions 164 as shown. The plurality of axial cylinder bores 140 in cylindrical casing section 37, there being five in the preferred embodiment, receive pistons 166 therein. The pistons 166 are sealed by rings 167 which in the disclosed form are Teflon washers as described in U.S. Pat. No. 3,885,460, assigned to the assignee of the present application. Pistons 166, shown in its top-dead-center position, has a socket-like formation 168 for engaging one end of the connecting rod 163. The pistons 166 operate within their associated compression chambers or bores 140 whereby upon rotation of the drive shaft 90 and the wobble plate 154 will cause reciprocation of the pistons 166 within their bores 140.

Figure 2:
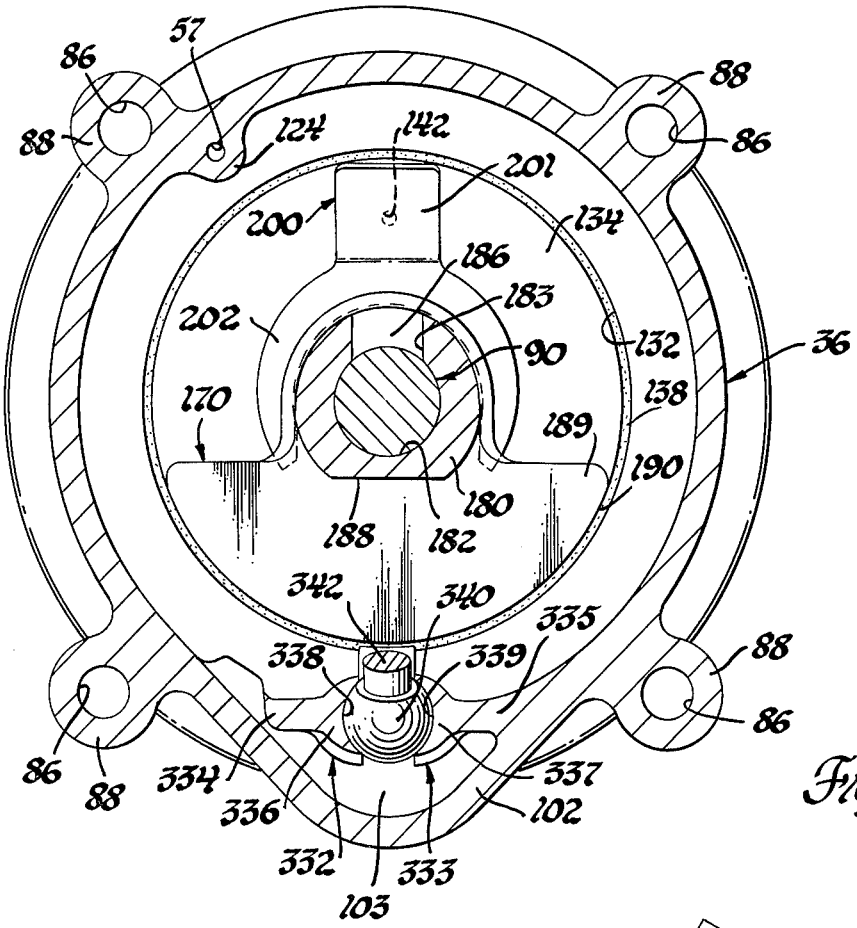
FIG. 2 is a vertical sectional view taken substantially along line 2—2 of FIG. 1.

The shaft 90 has a generally cylindrical sleeve and integral counterbalancing member 170 with the sleeve 180 surrounding or circumscribing the shaft in hydraulic sealing relation therewith by means of compressible sealing means such as O-ring seal 181 located in a groove in the inner surface 812 of the sleeve. The sleeve 180 has formed therein a longitudinal slot 183 extending from the sleeve inner or rearward face 184 substantially the full length of the sleeve and terminates in a U-shaped radiused portion 186 within the confines of the cylinder bore 132. The sleeve face 184 includes a chamfered front edge 187. It will be noted that the sleeve 180 has a flat face portion 188 located in 180° opposed relation to the slot 183. As seen in FIG. 2, integral counterweight or counterbalance 189 has a generally one-half disc shape with its arcuate outer edge 190 defined by a radius centered on the axis of shaft 90 and of a predetermined distance less than the radius of the bore 132 to allow the disc 189 to telescope within the bore 132 during maximum piston stroke as shown in FIG. 1. The member 170 includes an integral forwardly projecting hub 191 whose forward shoulder 192 is in rotatable abutting contact with thrust bearing 194. The thrust bearing 194 is located in concentric recess 196 formed in the cover 79 of the front section 36.

In the disclosed embodiment the modulating piston 134 is retained on the hub portion 191 by C-clip 193 whereby the sleeve and counterbalance member 170 rotate with the shaft while the piston 134 moves axially with the member 170 but does not rotate therewith. A return spring member 200, having a radiating leaf spring finger 201, as seen in FIG. 2, is positioned by means of its C-shaped retainer 202 concentrically on the sleeve within sleeve groove 203 for rotational and axial movement therewith. The spring member 200 is operative upon the modulating piston 134 and sleeve member 170 being moved axially to the left from its position in FIG. 1 to a compressed position contacting drive lug 210 with the wobble plate mechanism 100 being pivoted to a vertical or normal position relative to the shaft 90 as indicated by dash-dot lines. Thus, the spring finger member 200 functions to move the wobble plate mechanism 100 off its dead center or zero stroke position wherein the pistons 166 start pumping by biasing the disc-shaped piston 134 toward its full stroke position (FIG. 1).

As explained above, the modulating disc-shaped piston member 134 cooperates with the cylinder bore 132 to form the expansible chamber 130 the size of which is varied by supplying lubricant under pressure into the chamber. At high lubricant pressures, the piston 134 sleeve 180 and counterbalance 189 will be shifted axially to the left as shown by phantom lines. The chamber 130 may be unloaded when the piston 134 is moved to the right by removal of hydraulic fluid from chamber 130 by bleed aperture 110.

The shaft 90 drive lub portion 210, which in the disclosed form is tapered or conical in vertical section, extends in a transverse or normal direction to the drive shaft axis. The lug 210 has formed therein a guide slot or cam track 212 which extends radially along the axis of the drive shaft. The journal element 154 carries an ear-like member 214 projecting normal to the journal forward face 216 and has a through bore for receiving cam follower means in the form of a cross pin driving member 220. As seen in the above-mentioned U.S. patent application Ser. No. 747,043, the ear 214 is offset from but parallel to a plane common to drive shaft principal axis and the sleeve slot 183 an amount which allows the pin 220 to seat in bottom radius 213 of the cam track 212, with the journal element 154 disposed in a plane perpendicular to the axis of rotation of the shaft 90, rendering the compressor ineffective to compress refrigerant gas. This is because the pin 220 is located at the radially inward limit of cam track 212 defining minimum or zero stroke length for each of the pistons 166. FIG. 1 shows the arrangement of the wobble plate mechanism 100 for maximum compressor capacity wherein the pin 220 is positioned at the radially outer end of cam track 212 defining the maximum stroke lengths for each of the pistons 166. It will be noted in FIG. 1 that the drive lug 210 is received in a complementary cone-shaped bore 215 in drive shaft 90 and suitably secured therein as by a cross pin 217 to properly align and lock the lug 210 against any rotational movement in shaft bore 215.

As shown and described in the above-mentioned patent application Ser. No. 747,043, journal plate hub 224 has transverse bores 226 the axis of which intersect the rotational axis of shaft 90. Thus, the journal plate hub 224 receives the sleeve 180 in the hub's generally rectangular sectioned axial opening, defined in part by upper and lower faces 227 and 228. The chamfered surface 229, which provides a clearance with sleeve surface 188 in the full stroke position, can be a cast-in-place surface for use as is. Upon assembly the journal cross bores 226 are aligned with sleeve bores (not shown) for the reception of the hollow transverse pivot or trunnion pins 230 permitting the wobble plate assembly 40 to pivot thereabout.

As explained in the Black et al. patent application Ser. No. 747,043, the above-described arrangement of parts have opposite radiused ends 211 and 213 of the cam track 212 which provide one method to define respectively, the maximum and minimum stroke lengths for each of the pistons 166 in a manner to constrain the wobble plate assembly 40 providing essentially constant top-dead-center (TDC) positions for each of the pistons. Cam follower means in the form of the pin follower 220 interconnects the wobble plate mechanism 100 and the drive shaft 90 and is movable radially with respect to the lug 210 and the wobble plate mechanism 100 in response to the movement of the sleeve member 170, whereby the angle of the wobble plate mechanism is varied with respect to the drive shaft 90 to infinitely vary the stroke lengths of the pistons 166 and thus the output of the compressor.

The lubricating arrangement for applicants' compressor, as indicated in part by short arrows in FIG. 1, traces the oil being drawn up from the compressor sump area 103 in front section 36 through the pick-up passage 105 in section 37 for exiting its outlet 109 and through an aperture 110 in the suction inlet reed disc 74 and thence into the passage means in the form of the generally vertical slot or groove 112 formed in the inner face of the valve plate 72. The groove 112 upper arcuate portion 113 communicates with a kidney-shaped aperture 254 in the valve disc 74 arranged directly over the intake side 114 of the gear pump 104. The oil gear pump assembly 104 pressurizes the oil as the pump is rotated on the quill end 97 of the compressor shaft.

An internal flow path for the pump lubrication system is established by oil under pressure being discharged from the pump outlet through a slot 255 in the reed disc 74 into region 251 at the rear of the shaft end portion 97 for flow through an axial bore 262 in shaft 90 for travel forwardly to a pair of transverse shaft bores 264 aligned with wobble plate pin bores (not shown) for flow between the journal hub 224 and the socket plate hub 268 to lubricate the journal bearing surfaces 156 and 158.

The modulation oil flow path, indicated by dashed arrows 272 in FIG. 3, involves flow from the outlet of the pump 104 into the arcuate portion 116 and radial portion of the upper oil outlet groove 118 into the outer angled groove portion 120 for travel rearwardly through the orifice 122 in the valve plate 72 (FIG. 3) and thence via rear head passage 282 (FIGS. 1 and 5) for entrance into the blind end region or bore 284 of a hydraulic control valve generally indicated at 290 in FIG. 5. The valve 290 functions to control the amount of piston stroke by means of ball valve member 296 controlled by valve bellows 298 which senses evaporator pressure from the evaporator control unit 20 via line 302, passage 304 in the rear head section valve housing 306 and passage 308 in the valve casing 310.

As seen in FIG. 5, upon reaching the blind bore 284, the oil will flow through inlet 312 of valve stem 314 past the ball valve member 296 and thence into region 316 via axial stem bore 318 for exiting via exit bore 320. From exit bore 320 the oil returns to the compressor via rear head suction return bore 322 (FIG. 5) which communicates with valve plate hole 323 (FIG. 3) aligned for connection with the second section duct 56 of the axial crossover passage means. The duct portion 56 communicates with crossover duct portion 57, which in turn is connected to the front section radial passage 128 opening into the modulating chamber 130. The bores 326 and 327 in third section 38 (FIG. 4) receive locator pins 328 and 329 to align sections 37 and 38.

As seen in FIG. 1, the socket plate 152 is prevented from rotating without preventing angular movement thereof relative to the drive shaft 90 by a pair of complementary guide members 332 and 333. The guide members are formed integral with the front shell-like section 36 by means of webs 334 and 335 respectively, extending longitudinally along the interior of section 37 inner surface so as to terminate in the plane of edge 42. Each guide member includes a head portion 336, 337 having opposed concave cylindrical guides 338, 339 dimensioned to capture therebetween a guide in the form of a generally spherical guide shoe 340 for longitudinal travel between a forward solid line position and a rearward dash-dot line position.

The spherical guide shoe is mounted on a guide pin 342 projecting radially from one side of the socket plate 152 with the pin 342 rigidly retained by a press fit within plate bore 344. The shoe bore 346 is of a diameter whereby the shoe 340 is axially slidable or shiftable on pin 142 from its radial extended solid line position to its intermediate retracted dot-dash position wherein the socket plate 152 and wobble plate mechanism is normal to the axis of shaft 90. Thus, the spherical shoe provides an economical easily assembled arrangement whereby a friction reducing rolling line contact is maintained between the spherical shoe and each cylindrical section guide surface 338, 339.

While the embodiment of the present invention as herein disclosed constitutes a preferred form, it is to be understood that other forms might be adopted.

I claim:

1. A variable output axial compressor of the wobble plate type including a cast three part compressor housing having a first shell-like front section defining by integral portions thereof a wobble plate mechanism cavity and an expansible chamber, a second intermediate cylinder block section and a third rear cylinder head section connected in series to form said housing, a crankcase in said housing, a drive shaft having its one end journaled in an integral end cover of said first section and the shaft other end journaled in said second section, said second section having a cylinder bore formed therein substantially parallel to the axis of said shaft, a compressor piston arranged to reciprocate in said cylinder bore, a wobble plate mechanism in said cavity operated in response to rotation of said shaft and drivingly connected to said compressor piston, one of said first and second sections terminating in a rearwardly directed peripheral edge and the other of said first and second sections terminating in a forwardly directed planar face such that said first section edge and second section face are in flush engagement at a common transverse plane, means for removably interconnecting said first, second and third sections in axial alignment, said means including means whereby said first and second sections are sealably engaged at said transverse plane, compressor output modulation means for varying the angle of the wobble plate mechanism relative to said drive shaft and thus the stroke of said compressor piston in said cylinder bore, said first section end cover including a blind bore in the center thereof open to said wobble plate cavity, a modulation piston slidably received in said end cover blind bore thereby forming an expansible chamber, oil pump means in said housing, passage means for conducting oil from said housing crankcase to the inlet of said pump means and from the outlet of said pump means to said expansible chamber for effecting movement of said modulation piston, and control means regulating the flow of oil from said crankcase to said expansible chamber for causing the travel of said modulation piston to regulate said wobble plate mechanism and thus the pumping capacity of said compressor.

2. A variable output axial compressor of the wobble plate type including a cast aluminum three part compressor housing having a first shell-like front section defining a wobble plate mechanism cavity, a second intermediate cylinder block section and a third rear cylinder head section connected in series to form said housing, a crankcase in said housing, a drive shaft having its one end journaled in an integral end cover of said first section and the shaft other end journaled in said second section, said second section having a plurality of cylinder bores formed therein substantially parallel to the axis of said shaft, compressor pistons arranged to reciprocate in said cylinder bores, a wobble plate mechanism in said cavity operated in response to rotation of said shaft and drivingly connected to said compressor pistons, said first section terminating in a rearwardly directed peripheral edge and said second section terminating in a forwardly directed planar face such that said first section edge and second section face are in flush engagement at a common transverse plane, said second section having retaining means on its rearward face telescopically fitting said third section, means interconnecting said sections in axial alignment, means for removably attaching said third section to said first section whereby said first and second sections are sealably engaged at said transverse plane, compressor output modulation means for varying the angle of the wobble plate mechanism relative to said drive shaft and thus the stroke of said compressor pistons in said bores, an expansible chamber actuator including an axially movable modulation piston for actuating said modulation means, said first section end cover including a blind bore in the center thereof open to said wobble plate cavity, said modulation piston slidably received in said end cover blind bore thereby forming the expansible chamber of said actuator, oil pump means in said housing, passage means for conducting oil from said housing crankcase to the inlet of said pump means, oil outlet passage means including means for controlling flow of oil from the outlet of said pump means to said expansible chamber for effecting movement of said modulation piston, said control means regulating the flow of oil from said crankcase to said expansible chamber causing the travel of said modulation piston to regulate said wobble plate mechanism and thus the pumping capacity of said compressor.

3. A variable output axial compressor of the wobble plate type including a cast aluminum three part compressor housing having a first shell-like front section defining a wobble plate mechanism cavity, a second intermediate cylinder block section and a third rear cylinder head section connected in series to form said housing, a crankcase in said housing, a drive shaft having its one end journaled in an integral end cover of said first section and the shaft other end journaled in said second section, said second section having a plurality of cylinder bores formed therein substantially parallel to the axis of said shaft, compressor pistons arranged to reciprocate in said cylinder bores, a wobble plate mechanism in said cavity operated in response to rotation of said shaft and drivingly connected to said compressor pistons, said wobble plate mechanism including a journal plate having a central hub, support means slidable on said shaft supporting said journal plate for pivotal movement about a transverse axis, said journal plate being rotatable with said support means and said shaft, a socket plate supported on said journal hub, said socket plate having a plurality of sockets with each socket enclosing one spherical end of a connecting rod, each connecting rod having its other end universally connected to a compressor piston, said first section terminating in a rearwardly directed peripheral edge and said second section terminating in a forwardly directed planar face such that said first section edge and second section face are in flush engagement at a common transverse plane, compressor output modulation means for varying the angle of the wobble plate mechanism relative to said drive shaft whereby the connecting rods vary the stroke of their associated compressor piston in its bore, an actuator including an axially movable modulation piston slidably received in an expansible chamber for actuating said modulation means, said front section including a pair of integral guide members extending longitudinally from said end cover with their free ends terminating in said transverse plane, each said guide member having a cylindrical sectioned guide formed therein in complementary opposed relation, said pair of guides operative to define a guideway retaining a generally spherical guide shoe for longitudinal travel therein, said guide shoe being freely slidably mounted on a guide pin projecting radially from said socket plate, whereby said guide shoe moves conjointly in a reciprocal manner on said guide pin and longitudinally in said guideway during rotational movement of said journal plate with said drive shaft thereby limiting said socket plate to angular non-rotational movement.

* * * * *